US010214374B2

(12) United States Patent
Machida et al.

(10) Patent No.: US 10,214,374 B2
(45) Date of Patent: Feb. 26, 2019

(54) SHEET FEEDER, IMAGE READING APPARATUS, AND IMAGE FORMING APPARATUS

(71) Applicant: CANON DENSHI KABUSHIKI KAISHA, Chichibu-shi (JP)

(72) Inventors: Takashi Machida, Tokyo (JP); Yoshifumi Okamoto, Yokohama (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 28 days.

(21) Appl. No.: 15/156,665

(22) Filed: May 17, 2016

(65) Prior Publication Data

US 2016/0257511 A1 Sep. 8, 2016

Related U.S. Application Data

(63) Continuation of application No. PCT/JP2014/006051, filed on Dec. 4, 2014.

(30) Foreign Application Priority Data

Dec. 12, 2013 (JP) ..... 2013-257382

(51) Int. Cl.
*B65H 3/56* (2006.01)
*B65H 3/66* (2006.01)
(Continued)

(52) U.S. Cl.
CPC ..... *B65H 3/66* (2013.01); *B65H 1/04* (2013.01); *B65H 3/34* (2013.01); *B65H 3/56* (2013.01);
(Continued)

(58) Field of Classification Search
CPC ..... B65H 3/047; B65H 3/0661; B65H 3/52; B65H 3/5215; B65H 3/5246;
(Continued)

(56) References Cited

U.S. PATENT DOCUMENTS 5,462,267 A * 10/1995 Hori ..... B65H 3/0669 271/10.04
5,857,671 A * 1/1999 Kato ..... B65H 3/5223 271/10.11
(Continued)

FOREIGN PATENT DOCUMENTS

JP 63-76734 U 5/1988
JP 2001-088951 A 4/2001
(Continued)

OTHER PUBLICATIONS

International Search Report issued in parent International Application No. PCT/JP2014/006051 dated Feb. 10, 2015.
(Continued)

*Primary Examiner* — Ernesto A Suarez
(74) *Attorney, Agent, or Firm* — Venable LLP

(57) ABSTRACT

A sheet feeder comprises a sheet stacking unit which stacks sheets, a sheet pickup unit which picks up a sheet from one side of the stacked sheets on the sheet stacking unit, a sheet separating and feeding unit which separately feeds sheets one by one to a conveyance path, an orientation holding unit which holds a feed orientation of a sheet, and a biasing unit which biases the orientation holding unit from a retracted position to a projecting position. A projection amount of the orientation holding unit from an inclined surface increases as the number of stacked sheets decreases, and the projection amount from the inclined surface decreases as the number of stacked sheets increases.

7 Claims, 17 Drawing Sheets

(51) Int. Cl.
*B65H 1/04* (2006.01)
*B65H 5/06* (2006.01)
*B65H 3/34* (2006.01)

(52) U.S. Cl.
CPC ..... *B65H 5/062* (2013.01); *B65H 2402/441* (2013.01); *B65H 2404/611* (2013.01); *B65H 2404/722* (2013.01); *B65H 2404/725* (2013.01); *B65H 2405/1132* (2013.01); *B65H 2405/1134* (2013.01); *B65H 2405/1136* (2013.01)

(58) Field of Classification Search
CPC ..... B65H 3/5253; B65H 3/5261; B65H 3/56; B65H 3/66; B65H 3/68; B65H 2301/4232; B65H 2301/42324; B65H 2301/4234; B65H 2301/51214; B65H 2301/5122; B65H 2301/51256; B65H 2404/50; B65H 2404/511; B65H 2404/5131; B65H 2404/521; B65H 2404/61; B65H 2404/62; B65H 2404/623; B65H 2404/67; B65H 2404/693; B65H 2404/70; B65H 2404/722; B65H 2404/725; B65H 2404/74; B65H 2404/741; B65H 2404/7412; B65H 2404/7414; B65H 2405/11151; B65H 2405/11161; B65H 2405/11162; B65H 2405/1134; B65H 2405/1136; B65H 2601/254; B65H 2601/255; B65H 2601/2531
See application file for complete search history.

(56) References Cited

U.S. PATENT DOCUMENTS 6,126,161 A * 10/2000 Kato ..... B65H 3/5223 271/114
6,308,947 B1 10/2001 Kojima et al.
6,382,621 B1 * 5/2002 Inoue ..... B65H 3/0661 271/120
6,540,220 B2 * 4/2003 Kuo ..... B65H 3/0615 271/110
6,616,138 B2 * 9/2003 Tanaka ..... B65H 1/02 271/113
6,880,821 B2 * 4/2005 Park ..... B65H 1/04 271/109
7,455,288 B2 * 11/2008 Ruhe ..... B65H 1/04 271/124
7,543,811 B2 * 6/2009 Shimamura ..... B65H 3/56 271/117
7,591,461 B2 * 9/2009 Lien ..... B65H 1/04 271/126
8,356,810 B2 * 1/2013 Aruga ..... B65H 1/266 271/121
9,181,050 B2 11/2015 Machida et al.
9,371,204 B2 * 6/2016 Inoue ..... B65H 3/56
2004/0245703 A1 * 12/2004 Yun ..... B65H 3/0684 271/110
2010/0038847 A1 * 2/2010 Bokelman ..... B65H 3/0684 271/264
2010/0270732 A1 * 10/2010 Huang ..... B65H 3/0661 271/109
2011/0156339 A1 6/2011 Nakano
2014/0151954 A1 * 6/2014 Furusawa ..... B65H 3/5215 271/160

FOREIGN PATENT DOCUMENTS

JP 2003-118865 A 4/2003
JP 2011-042440 A 3/2011
JP 2011-111237 A 6/2011

OTHER PUBLICATIONS

European Search Report issued in corresponding European Application No. 14870569.2 dated Jun. 27, 2017.

* cited by examiner

SHEET FEEDER, IMAGE READING APPARATUS, AND IMAGE FORMING APPARATUS

This application is a continuation of International Patent Application No. PCT/JP2014/006051 filed on Dec. 4, 2014, and claims priority to Japanese Patent Application No. 2013-257382 filed on Dec. 12, 2013, the entire content of both of which is incorporated herein by reference.

TECHNICAL FIELD

The present invention relates to a sheet feeder for feeding a sheet, and an image reading apparatus and image forming apparatus including the sheet feeder.

BACKGROUND ART

The configuration of a sheet feeder incorporated into a conventional image reading apparatus will be explained with reference to FIGS. 13 to 17, but the same reference numerals as in embodiments to be described later denote the same parts, and an explanation thereof will be omitted.

FIGS. 13 to 16 show the orientation of the leading edges of stacked documents D when a conventional sheet feeder 102 feeds the documents. When feed is started from a document sheet set state shown in FIG. 13, the leading edges of the stacked documents are obliquely misaligned along an inclined surface 2*b* of a lower guide unit 2 as shown in FIG. 14, and the number of stacked documents D decreases when feed is continued as shown in FIG. 15. When feed is performed in this state shown in FIG. 15, the uppermost document sheet to be fed is given no slack and pulled between a pickup roller 8 and feed roller 9 as shown in FIG. 16, because the rotational speed of the feed roller 9 is higher than that of the pickup roller 8. Assuming that a triangular region connecting a contact point p1 between the pickup roller 8 and the uppermost document sheet, a contact point p2 between the feed roller 9 and a separation roller 4, and an intersection p3 between a document sheet stacker 2*a* and the inclined surface 2*b* is a warp space, a portion of the uppermost document sheet, which is close to this warp space, moves in the direction of an arrow e.

In the process from FIG. 15 to FIG. 16, when the portion of the uppermost document sheet, which is close to the warp space, is displaced in the direction of the arrow e, the leading edge of the second document sheet is stopped by the separation roller 4, so a portion of the second document sheet, which is close to the warp space, is in tight contact with the uppermost document sheet. Accordingly, the second document sheet is displaced in the direction of the arrow e following the movement of the uppermost document sheet. Referring to FIG. 16, a length L2 of the second document sheet between the points p1 and p2 is larger than a length L1 of the uppermost document sheet between the points p1 and p2. When the second document sheet moves in the direction of the arrow e, therefore, the second document sheet readily slackens in the warp space as shown in FIG. 17. Also, since the frictional force between the uppermost document sheet and second document sheet in contact with each other at the point P1 is large, there is the possibility that the second document sheet moves following the feed of the uppermost document sheet and warps in the warp space. In particular, a thin document sheet such as paper or a film readily warps. If this warp of the document sheet increases in the warp space, the document sheet bends and becomes wrinkling, and cannot smoothly enter the nip between the feed roller 9 and separation roller 4 any longer. This causes a feed defect.

As a related art, Patent Document 1 describes a technique by which when the number of stacked documents on a feed tray becomes smaller than a predetermined reference number, the rotation of an eccentric cam driven by a cam driving motor raises a lifting member, the lifting member lifts a document sheet picked up by a pickup roller, thereby making the entrance angle of the document sheet almost horizontal with respect to a feed nip portion regardless of the number of stacked documents on the feed tray.

PRIOR ART DOCUMENT

Patent Document

PATENT DOCUMENT 1: Japanese Patent Laid-Open No. 2011-111237

SUMMARY OF INVENTION

Problems that the Invention is to Solve

According to Patent Document 1, the lifting member can reduce a slack of a document sheet. However, when feeding a hardly bendable document sheet such as a plastic card, the lifting member applies a large load to the document sheet, so a feed defect such as no feed of the document sheet may occur. Also, no document sheet can be added below the stacked documents because the document sheet abuts against the lifting member. Furthermore, the lifting member requires a driving mechanism including the motor and cam, so the number of parts increases, and the cost increases.

Note that the above-described problem may arise regardless of, for example, the form of sheet stacking (a so-called vertical stacking type in which sheets are stacked in the horizontal direction, a so-called horizontal stacking type in which the sheet surface is in the horizontal direction, and a so-called inclined stacking type in which stacked sheets are inclined in the horizontal stacking type), because a sheet readily slackens between a sheet pickup unit such as a pickup roller which picks up a sheet from one side of stacked sheets, and a sheet separating and feeding unit for separately feeding a sheet downstream of the sheet pickup unit. Note also that the explanation of the above-described related art merely shows an example of the conventional problems, and does not limit the present invention.

The present invention has been made in consideration of the above problem, and provides a technique capable of inexpensively implementing a sheet feeder, image reading apparatus, and image forming apparatus capable of improving or stabilizing the feed performance regardless of the thickness (flexibility) of a sheet.

Means for Solving the Problems

The present invention provides a sheet feeder comprising: a sheet stacking unit configured to stack sheets; a sheet pickup unit configured to pick up a sheet from one side of the stacked sheets on the sheet stacking unit; and a sheet separating and feeding unit, formed downstream of the sheet feeding unit in a sheet feeding direction, separately feed sheets one by one to a conveyance path, wherein a sheet picked up from the sheet stacking unit by the sheet pickup unit is separately fed from the sheet stacking unit to the conveyance path on the downstream side in the sheet feeding direction via an inclined surface inclining in the sheet feeding direction, further comprising an orientation holding unit configured to hold a feed orientation of a sheet currently being separately fed by acting on the sheet is formed between the sheet pickup unit and the sheet separating and feeding unit, and a biasing unit configured to bias the orientation holding unit from the retracted position to the projecting position, the orientation holding unit is displaceable between a position where the orientation holding unit projects from the inclined surface and a position where the orientation holding unit is retracted, in the vicinity of an intersection between the sheet stacking unit and the inclined surface, and a projection amount of the orientation holding unit from the inclined surface increases as the number of stacked sheets decreases, and the projection amount from the inclined surface against a biasing force of the biasing unit decrease as the number of stacked sheets increases, and the orientation holding unit has a function of holding the feed orientation of a sheet picked up from the sheet stacking unit by the sheet pickup unit, by pushing up the sheet in the projecting position.

Also, the present invention provides an image reading apparatus and image forming apparatus including the above-mentioned sheet feeder.

Effects of the Invention

The present invention provides a technique of inexpensively implementing a sheet feeder, image reading apparatus, and image forming apparatus capable of improving or stabilizing the feed performance regardless of the thickness (flexibility) of a sheet while maintaining the performance of separating sheets one by one.

Other features and advantages of the present invention will be apparent from the following explanation taken in conjunction with the accompanying drawings. Note that the same reference numerals denote the same or similar parts in the accompanying drawings.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF EMBODIMENTS

Embodiments for carrying out the present invention will be explained in detail below with reference to the accompanying drawings. The following embodiments are examples for implementing the present invention, so the present invention is not limited to the following embodiments. The dimensions, materials, shapes, relative positions, and the like of the constituent parts of the embodiments should properly be modified or changed without departing from the spirit and scope of the present invention in accordance with the configuration of an apparatus to which the present invention is applied and with various conditions.

An embodiment in which a sheet feeder of the present invention is applied to an image reading apparatus for reading a document sheet image by conveying a document sheet. Note that the present invention is not limited to an image reading apparatus such as a document sheet scanner, and is also applicable to an image forming apparatus such as a facsimile apparatus, printer, or copying machine.

[Apparatus Configuration] The configuration and function of the image reading apparatus in which the sheet feeder of the embodiment according to the present invention is incorporated will be explained with reference to FIGS. 1 to 3.

Figure 1:
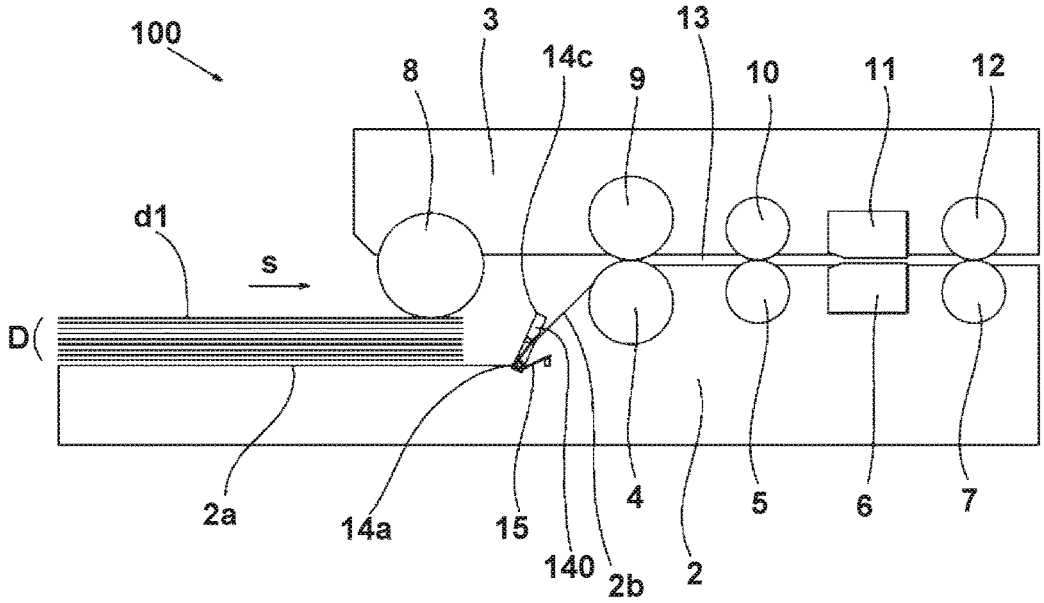
FIG. 1 is a schematic side view of a sheet feeder of the first embodiment.
Figure 2:
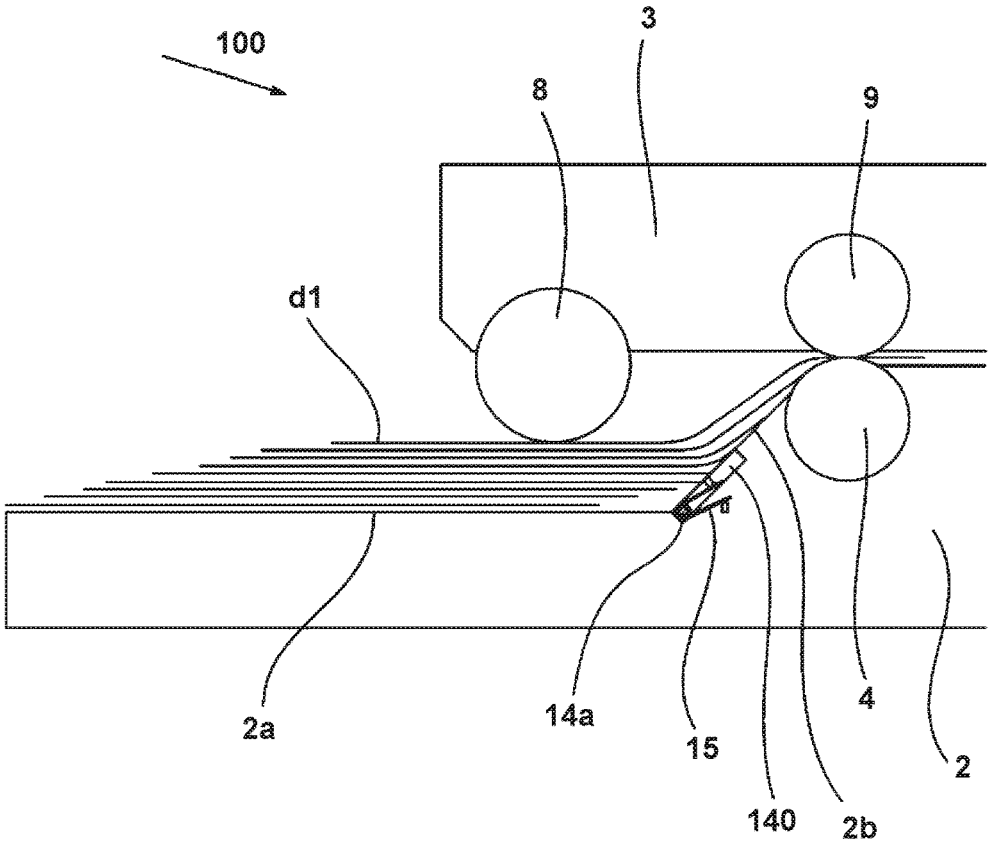
FIG. 2 is a schematic side view of the sheet feeder of the first embodiment.
Figure 3:
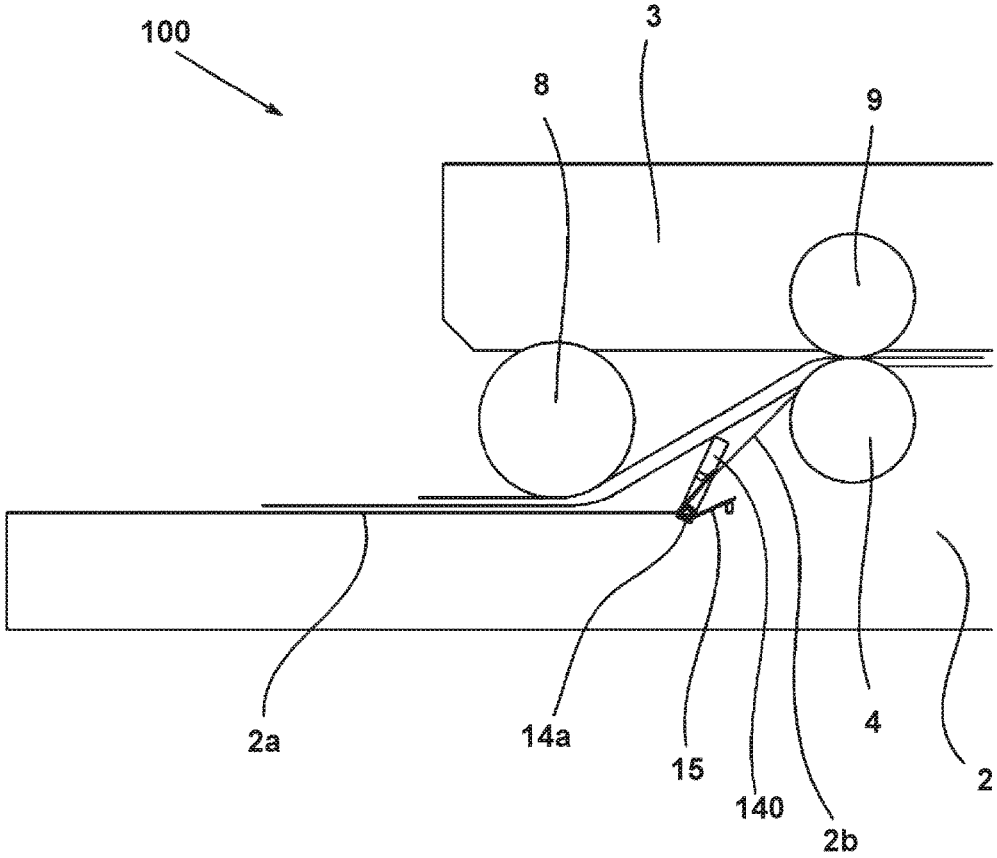
FIG. 3 is a schematic side view of the sheet feeder of the first embodiment.

As shown in FIGS. 1 to 3, a horizontal document sheet stacking type image reading apparatus 100 includes a lower guide unit 2 forming a lower conveyance path, and an upper guide unit 3 forming an upper conveyance path. A conveyance path 13 for a document sheet D is formed in a space sandwiched between the lower guide unit 2 and upper guide unit 3.

The lower guide unit 2 includes a horizontal document sheet stacking type document sheet stacker (an example of a sheet stacking unit) 2*a* on which documents D are horizontally stacked, an inclined surface 2*b* for separating documents, a separation roller 4, an upstream-side conveyor roller 5, a lower read sensor 6, a downstream-side conveyor roller 7, and a guide plate 140. The upper guide unit 3 includes a pickup roller (an example of a sheet pickup unit) 8, a feed roller 9, an upstream-side conveyor roller 10, an upper read sensor 11, and a downstream-side conveyor roller 12. Note that the two end portions of the documents D in the widthwise direction are regulated by a pair of regulating plates (not shown) slidably standing along the stacking surface on the document sheet stacker 2*a*. That is, the pair of regulating plates prevent skew of the documents D in the document sheet pickup direction.

The lower read sensor 6 and upper read sensor 11 face each other with the conveyance path 13 being sandwiched between them. On the conveyance path 13, the pair of upstream-side conveyor rollers 5 and 10 abut against each other, and the pair of downstream-side conveyor rollers 7 and 12 abut against each other. The upstream-side conveyor roller 5 and downstream-side conveyor roller 7 are driving rollers which are driven by motors (not shown), and the upstream-side conveyor roller 10 and downstream side conveyor roller 12 are driven rollers.

The pickup roller 8, feed roller 9, and separation roller 4 form a unit configured to pick up a document sheet and separately feeding it, and are rotated by motors (not shown). The pickup roller 8 is arranged to correspond to a central portion of a document sheet in the widthwise direction (a central portion of the apparatus main body), and rotates in the sheet feeding direction indicated by an arrow s while being in tight contact with an uppermost document sheet dl (on one side) of the documents D stacked on the document sheet stacker 2*a*, and the feed roller 9 and separation roller 4 separately feed the documents picked up by the pickup roller 8 one by one to the conveyance path 13 on the downstream side in the sheet feeding direction. That is, in this embodiment, the feed roller 9 and separation roller 4 on the downstream side of the pickup roller 8 in the sheet pickup direction function as a document (sheet) separating and feeding unit. In this case, to prevent a document sheet from slackening between the pickup roller 8 and feed roller 9, driving is performed such that the rotational speed of the pickup roller 8 is lower than that of the feed roller 9. A one-way clutch (not shown) is formed in the pickup roller 8. When a document sheet fed from the document sheet stacker 2*a* arrives at the feed roller 9 and is pulled between the pickup roller 8 and feed roller 9 due to the rotational speed difference between them, the one-way clutch is unlocked, so the pickup roller 8 can rotate in the document sheet feeding direction. The separation roller 4 is driven in contact with the feed roller 9. Thus, the separation roller 4 rotates in a direction opposite to that of the feed roller 9, and separates the document sheet dl fed from the documents D.

The lower read sensor 6 and upper read sensor 11 optically read images on the lower surface and upper surface of the document sheet dl stably conveyed as it is sandwiched between the upstream side and downstream side by the rotation of the pair of the upstream-side conveyor rollers 5 and 10 and the downstream-side conveyor rollers 7 and 12.

The guide plate 140 is axially supported to be swingable around a shaft 14*a* in the vicinity of the intersection between the document sheet stacker 2*a* and inclined surface 2*b* of the lower guide unit 2, and displaceable between a position where the guide plate 140 projects from the inclined surface 2*b* and a position where the guide plate 140 is retracted. The spring force of a torsion spring 15 as a biasing unit always biases the guide plate 140 to the position where the guide plate 140 projects from the inclined surface 2*b*. An apex 14*c* of the guide plate 140 shown in FIG. 1 is a portion which is positioned on a straight line connecting the contact points p1 and p2 shown in FIG. 16, and comes in contact with a document sheet.

FIGS. 1 to 3 show the leading edges of the stacked documents D when the sheet feeder of this embodiment feeds the documents. In a document sheet set state shown in FIG. 1, the guide plate 140 projects from the inclined surface 2*b* due to the biasing force of the spring 15. When feed is started from the state shown in FIG. 1, the guide plate 140 is pushed by documents against the biasing force of the spring 15 and retracted from the inclined surface 2*b* to form an almost flat surface as shown in FIG. 2. More specifically, the guide plate 140 is accommodated in a recess formed in the inclined surface 2*b*, so the leading edges of documents are obliquely misaligned along the inclined surface 2*b* inclining in the document sheet feeding direction. When feed is continued and the number of stacked documents D decreases as shown in FIG. 3, the force pushing the guide plate 140 (that is, the force pushing the guide plate 140 toward the inclined surface 2*b*, and the weight of the stacked sheets in this embodiment) relatively decreases. Accordingly, the guide plate 140 begins projecting from the inclined surface 2*b* again due to the biasing force of the spring 15, and the projection amount of the guide plate 140 increases as the number of stacked documents decreases. That is, when the projection amount of the guide plate 140 increases, the acting force (in this embodiment, the push-up force) on a document sheet before being separately fed practically increases, so the feed orientation of the document sheet can be held.

Figure 16:
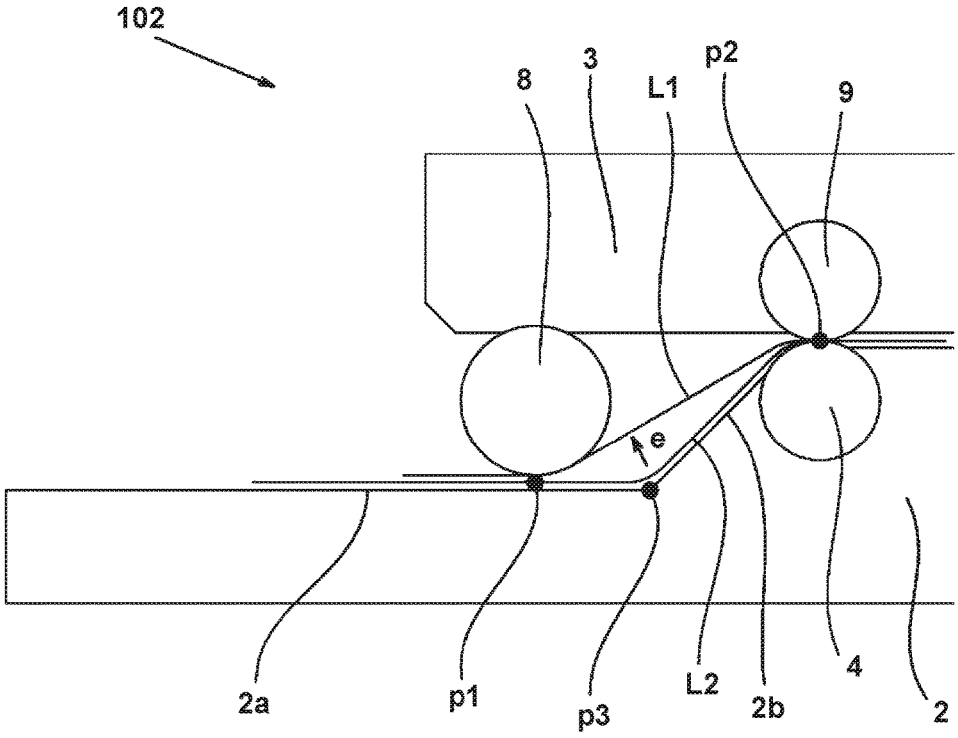
FIG. 16 is a schematic side view of the conventional sheet feeder.
Figure 17:
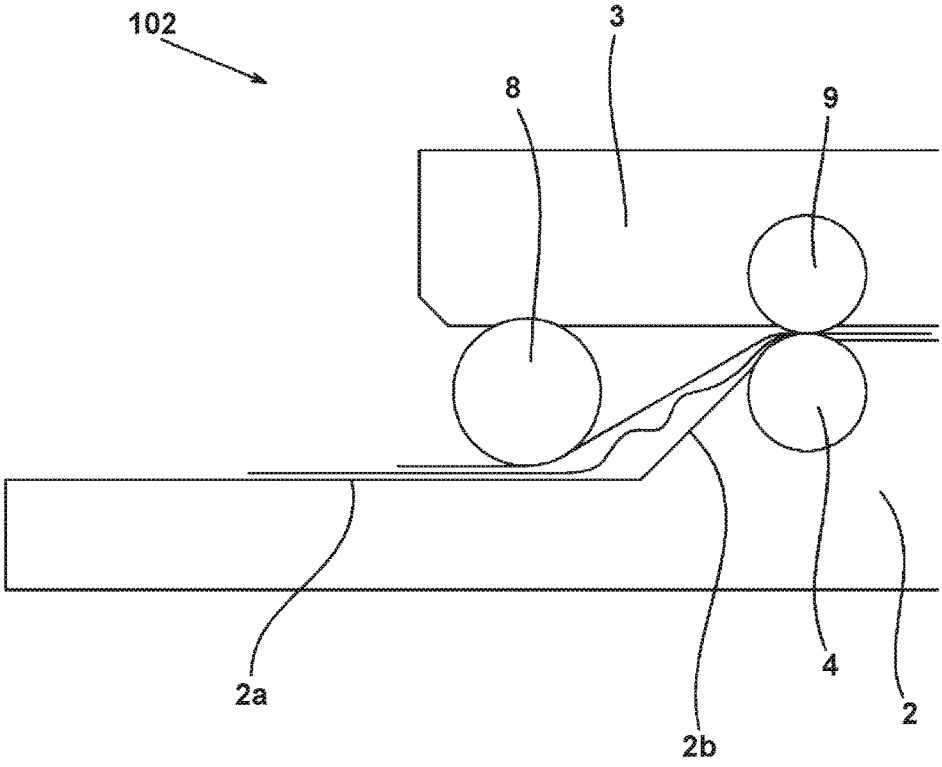
FIG. 17 is a schematic side view of the conventional sheet feeder.

When the number of stacked documents further decreases, as shown in FIG. 3, the guide plate 140 pushes up a lower document sheet (on the document sheet stacking surface side) toward a document sheet above the lower document sheet, so the position of the second document sheet becomes higher than that of the second document sheet shown in FIG. 16. When feeding the uppermost document sheet, therefore, the second document sheet hardly moves in the direction of the arrow e. Since this reduces a slack (deformation amount) of the second document sheet, a feed defect can be suppressed. The guide plate 140 has a function of suppressing a document sheet slack by pushing up a document sheet before being separately fed against a document sheet currently being separately fed, thereby stabilizing the orientation of the document sheet before being separately fed. That is, this member is explained as the guide plate 140 in this embodiment, but the guide plate 140 has the function of a document sheet orientation holding unit configured to hold (correct) the feed orientation of a document sheet by acting on a document sheet before being separately fed with respect to a document sheet currently being separately fed, and does not simply guide a document sheet to be separately fed. This document sheet orientation holding unit can be a rib-like projection which partially abuts against a document sheet (this projection is of course formed to be retractable), and can also be a unit configured to spray air, except that the document sheet orientation holding unit holds the feed orientation of a document sheet before being separately fed by abutting, as the guide plate 140, against the document sheet as in this embodiment. By thus stabilizing the feed orientation of a document sheet, it is possible to reduce feed defects and improve the feed performance and reliability. Note that the state of "currently being separately fed" includes a state in which a document sheet is directly receiving the feeding force between the pickup roller 8 and the pair of the feed roller 9 and separation roller 4. Note also that in this embodiment, the document sheet orientation holding unit like this is formed between the sheet pickup unit as the above-described pickup roller 8 and the sheet separating and feeding unit including the feed roller 9 and separation roller 4, and contributes to stabilizing the orientation of a sheet to be separately fed with respect to a document sheet separately fed by the action of the sheet pickup unit. Accordingly, the document sheet orientation holding unit can hold a sheet over a broad range within a region corresponding to a portion between the sheet pickup unit and sheet separating and feeding unit, and can also partially hold a sheet. Note that the document sheet orientation holding unit is preferably formed to correspond to a belt-like feed region connecting the sheet pickup unit and sheet separating and feeding unit.

For example, when feeding a hardly bendable document sheet such as a plastic card, as shown in FIG. 2, the guide plate 140 is pushed back by the document sheet and retracted from the inclined surface 2*b*. Therefore, the document sheet can reliably be fed without any unnecessary force being applied to it. That is, the acting force of the guide plate 140 is so adjust as to act on a few documents, particularly, a very thin document sheet (thin paper). The guide plate 140 like this is effective for the above-described feed orientation stabilization in so-called different kind mixed feed in which various kinds of documents including a card are mixed.

Also, in Patent Document 1 described previously, the cost is high because the lifting member requires the driving mechanism including the motor, cam, and the like. By contrast, this embodiment is advantageous in cost because only the guide plate 140 and spring 15 are necessary. Note that when adding documents, the additional documents can be inserted between the lowermost stacked document sheet and document sheet stacker 2*a*. Since the guide plate 140 is pushed back and retracted, this is advantageous in free document sheet addition.

Second Embodiment

An image reading apparatus in which a sheet feeder of the second embodiment is incorporated will be explained below with reference to FIGS. 4 to 9.

Figure 4:
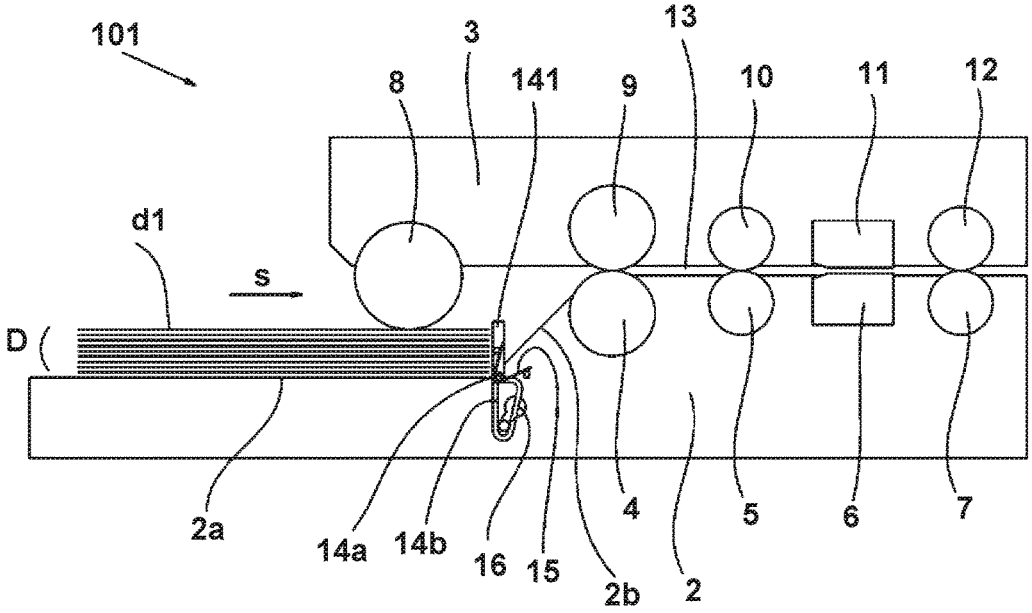
FIG. 4 is a schematic side view of a sheet feeder of the second embodiment.

As shown in FIG. 4, an image reading apparatus 101 of this embodiment includes a guide plate 141 which includes a cam engaging groove 14*b*, a cam member 16 which abuts against the cam engaging groove 14*b*, and a driving mechanism (not shown) for driving the cam member 16. The rest of the configuration is the same as that shown in FIG. 1.

Figure 5:
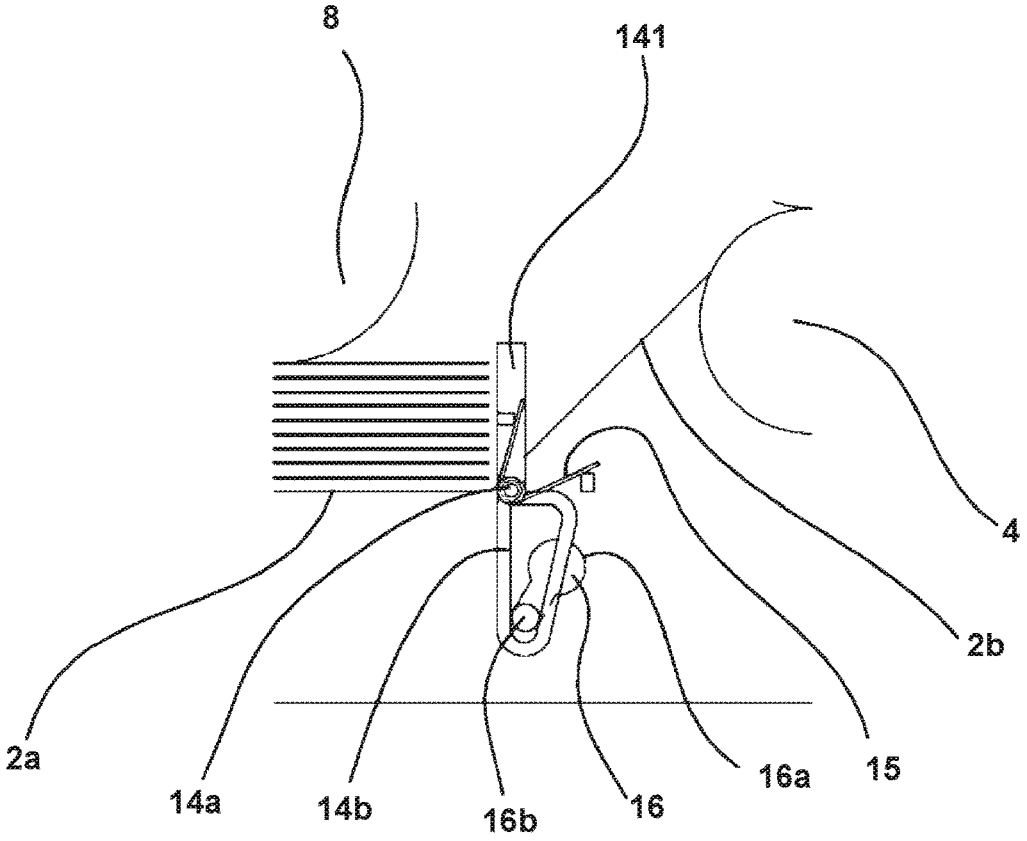
FIG. 5 is a schematic side view of a guide plate and its vicinity of the second embodiment.
Figure 6:
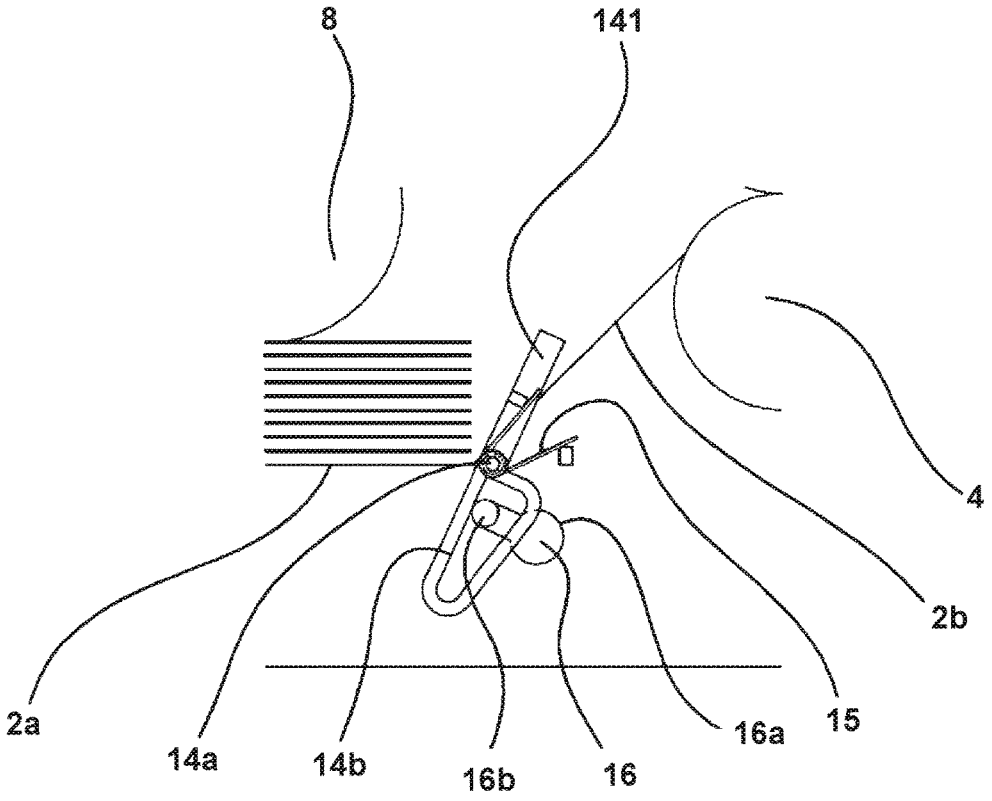
FIG. 6 is a schematic side view of the guide plate and its vicinity of the second embodiment.

FIG. 5 is an enlarged view of the guide plate 141 and its vicinity. The cam member 16 is supported by a lower guide unit 2 so as to be rotatable around a shaft 16*a*, and rotated by the driving mechanism (not shown). The cam member 16 has a cam engaging projection 16*b* which engages with the cam engaging groove 14*b*. The cam engaging projection 16*b* abuts against and moves along the cam engaging groove 14*b* as the cam member 16 rotates, thereby rotating the guide plate 141. The state shown in FIG. 5 is a document sheet set state in which the guide plate 141 takes an upright posture perpendicular to the document sheet surface, and the user can set a document sheet by causing it to abut against the guide plate 141. That is, the guide plate 141 also functions as a regulating member for aligning the document sheet leading edges. When starting feed after setting a document sheet, the driving mechanism (not shown) rotates the cam member 16 clockwise, thereby setting a document sheet scan state in which the guide plate 141 changes from the upright posture to a posture inclining in the clockwise direction, as shown in FIG. 6. When feed is complete, the cam member 16 is rotated counterclockwise and returned to the document sheet set state (FIG. 5) in which the guide plate 141 stands upright.

FIGS. 4 and 7 to 9 show the orientation of the stacked document sheet leading edges when feeding the documents by the sheet feeder of this embodiment. FIG. 4 shows the document sheet set state in which the guide plate 141 holds the upright posture by being supported by the cam member 16. When stacking documents on a document sheet stacker 2*a* in this state, the user sets the documents by causing the document sheet leading edges to abut against the guide plate 141.

Figure 7:
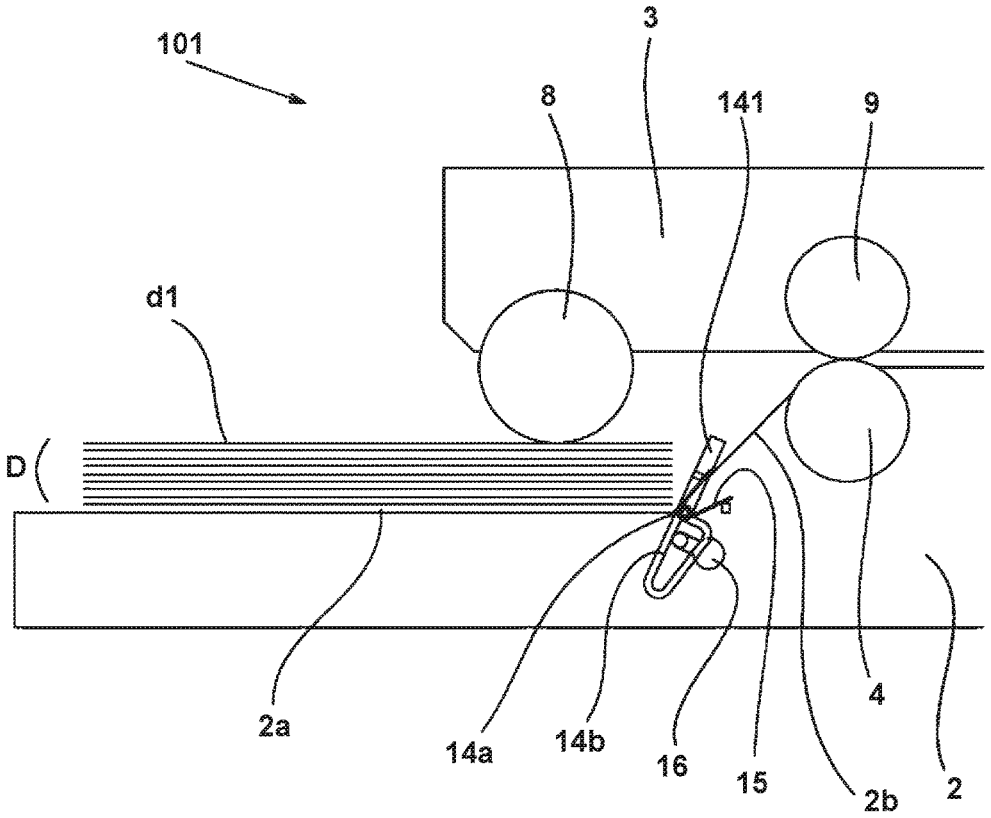
FIG. 7 is a schematic side view of the sheet feeder of the second embodiment.
Figure 8:
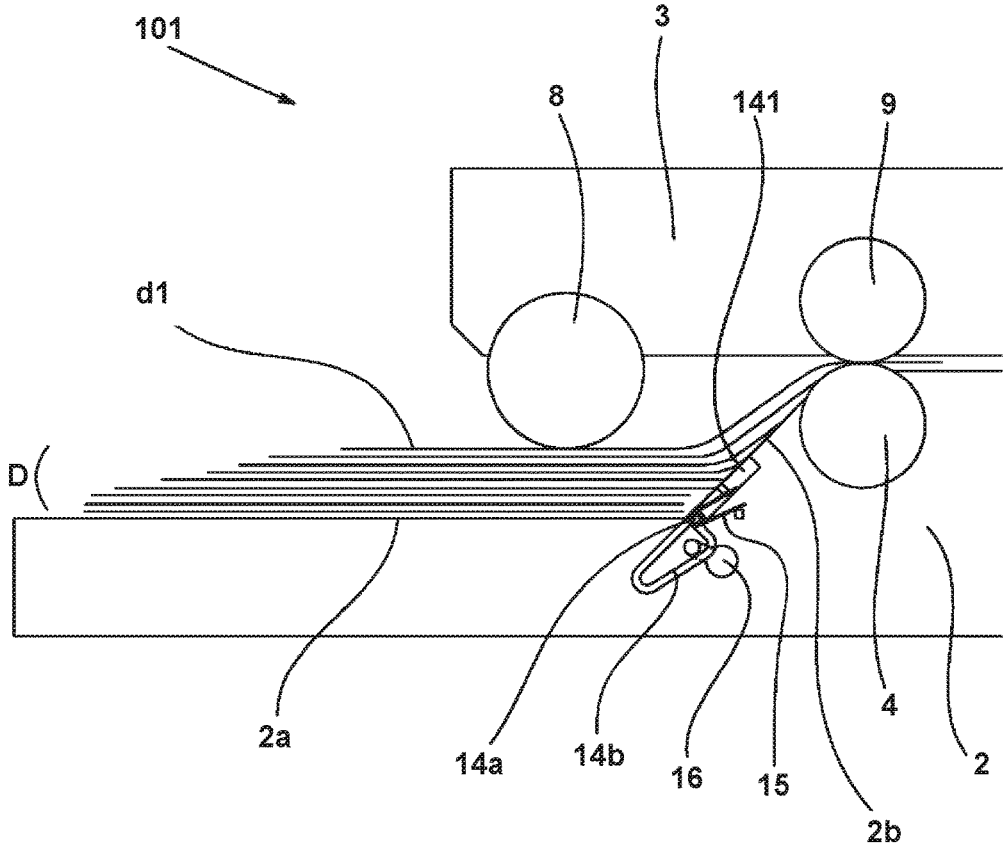
FIG. 8 is a schematic side view of the sheet feeder of the second embodiment.

When starting feed after setting documents, the driving mechanism (not shown) rotates the cam member 16 clockwise, thereby setting the guide plate 141 in an inclined posture as shown in FIG. 7. After that, feed is started by rotating the pickup roller 8. When feed is started, the guide plate 141 is pushed back by documents and retracted from an inclined surface 2*b*, so the leading edges of the documents are obliquely misaligned along the inclined surface 2*b*, as shown in FIG. 8.

Figure 9:
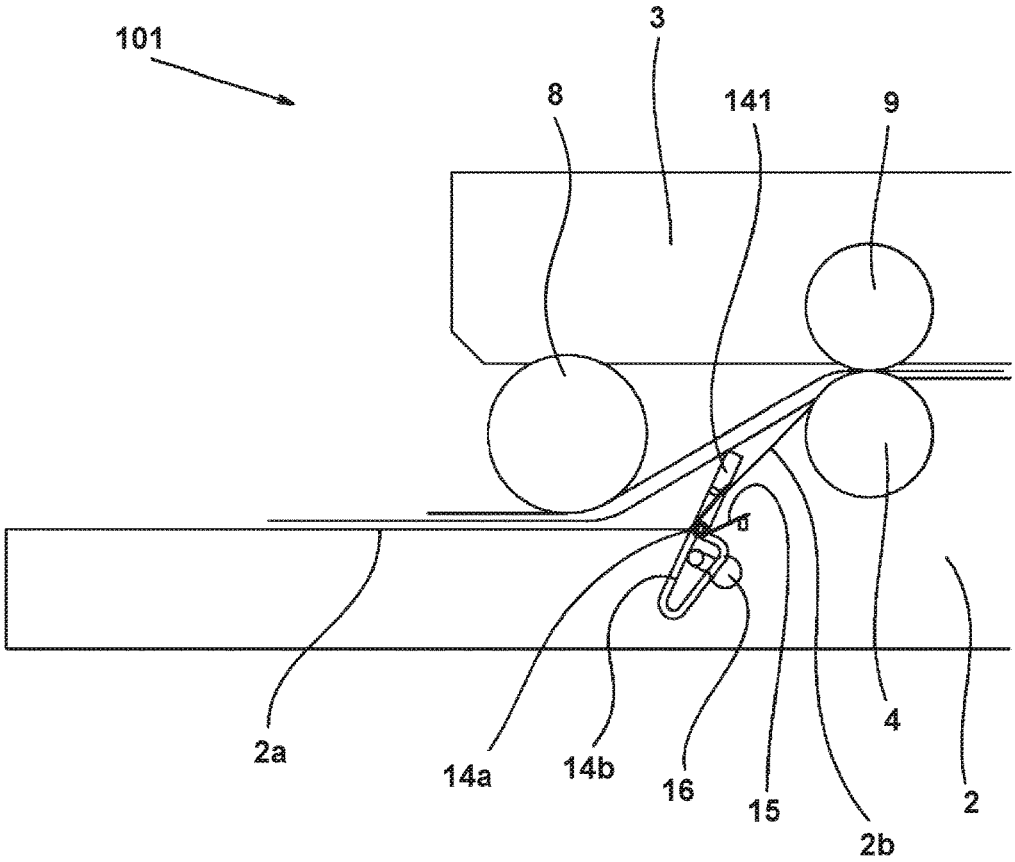
FIG. 9 is a schematic side view of the sheet feeder of the second embodiment.

When feed is further continued, the number of stacked documents reduces as shown in FIG. 9, and the force pushing the guide plate 141 weakens. Consequently, the projection amount of the guide plate 141 from the inclined surface 2*b* increases. Since the guide plate 141 thus pushes up a lower document sheet, a slack of the document sheet reduces, and a feed defect can be suppressed.

In this embodiment, the guide plate 141 has a document sheet abutment function when setting the document sheet and improves the feed performance.

Note that the guide plate 141 is driven by the cam in this embodiment, but the present invention is not limited to this, and it is also possible to use gear driving or another driving unit.

Third Embodiment

An image reading apparatus in which a sheet feeder of the third embodiment is incorporated will be explained below with reference to FIGS. 10A and 10B.

Figure 10A:
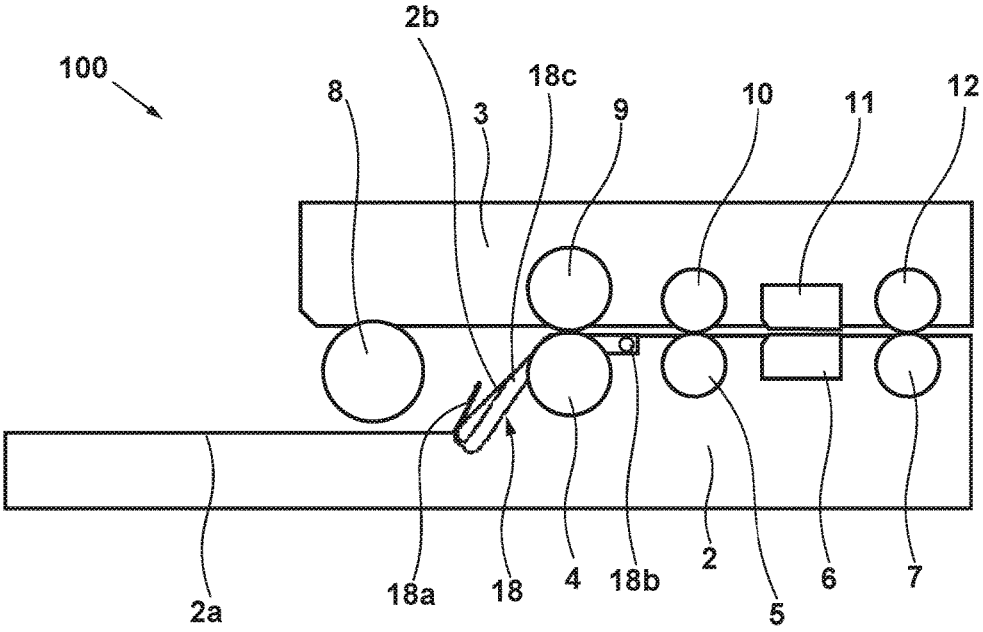
FIG. 10A is a schematic side view of a sheet feeder of the third embodiment.
Figure 10B:
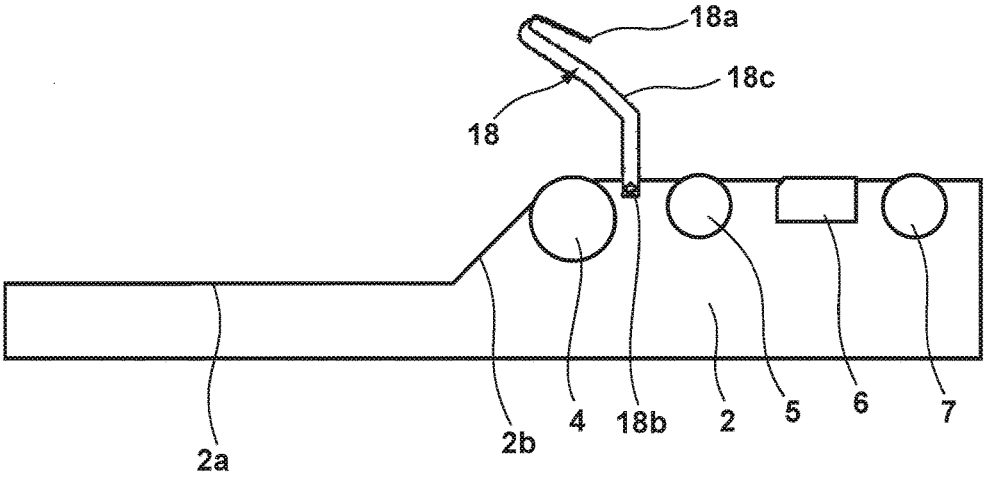
FIG. 10B is a schematic side view of the sheet feeder of the third embodiment.

As shown in FIGS. 10A and 10B, in an image reading apparatus 100 of this embodiment, a cover member 18 for covering a portion around a separation roller 4 is pivotally formed on an inclined surface 2*b* of a lower unit 2. The rest of the configuration is the same as that shown in FIG. 1.

The cover member 18 is pivotally connected via a pivoting shaft 18*b* on the downstream side in the document sheet feeding direction from the separation roller 4 of the lower unit 2. That is, the cover member 18 is a cover for covering the portion around the separation roller 4, and is a lid member which can be opened/closed as shown in FIG. 10B when replacing the separation roller 4. Also, the cover member 18 has an inclined portion 18*c* extending from a portion surrounding the portion around the separation roller 4. The inclined portion 18*c* of the cover member 18 forms a part of the inclined surface 2*b* of the lower unit 2. More specifically, in a state in which the cover member 18 is accommodated in a recess of the inclined surface 2*b* of the lower guide unit 2 as shown in FIG. 10A, the inclined portion 18*c* of the cover member 18 extends along a line connecting a pickup roller 8 and a feed roller 9 (or the separation roller 4). A folded clawed guide portion 18*a* is integrated with the distal end portion of the inclined portion 18*c* of the cover member 18. When the cover member 18 is accommodated in the recess of the inclined surface 2*b* of the lower guide unit 2, the guide portion 18*a* of the cover member 18 projects from the inclined surface 2*b* (see FIG. 10A). Also, the guide portion 18*a* of the cover member 18 bends and deforms with respect to the inclined portion 18*c* in accordance with the number (weight) of documents.

When document sheet feed from a document sheet stacking surface 2*a* is started in the state shown in FIG. 10A, the guide portion 18*a* bends and deforms in accordance with the number of documents passing over the guide portion 18*a*, thereby supporting the documents from the side of the lower guide unit 2. When feeding an unfirm document sheet such as thin paper, therefore, it is possible to support the document sheet from the side of the lower guide unit 2, and form a good feed orientation. In this embodiment as described above, when feeding thin paper in the final stage of stacked documents, the feed performance for this thin paper can be improved.

Fourth Embodiment

An image reading apparatus in which a sheet feeder of the fourth embodiment is incorporated will be explained below with reference to FIGS. 11A, 11B, and 12.

Figure 11A:
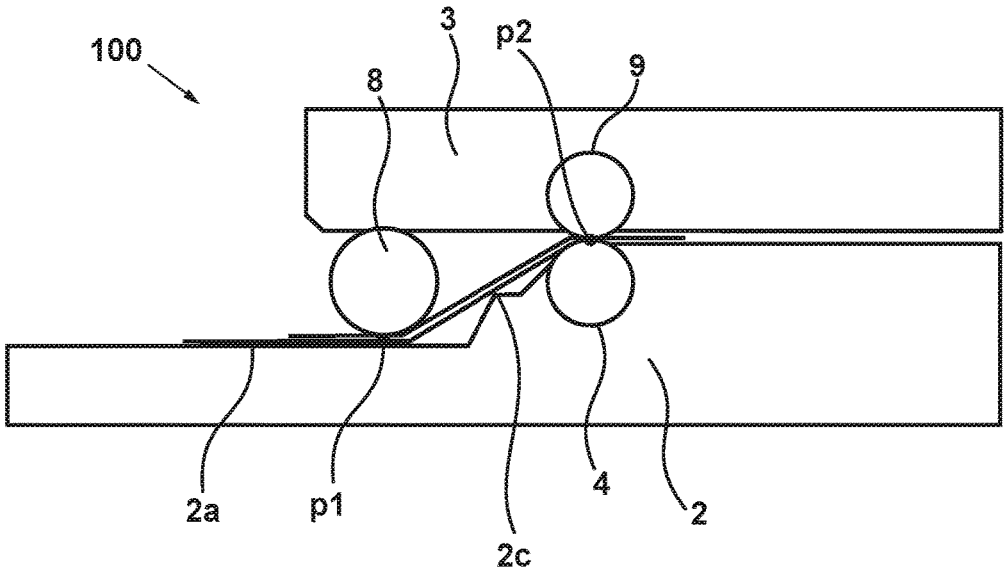
FIG. 11A is a schematic side view of a sheet feeder of the fourth embodiment.
Figure 11B:
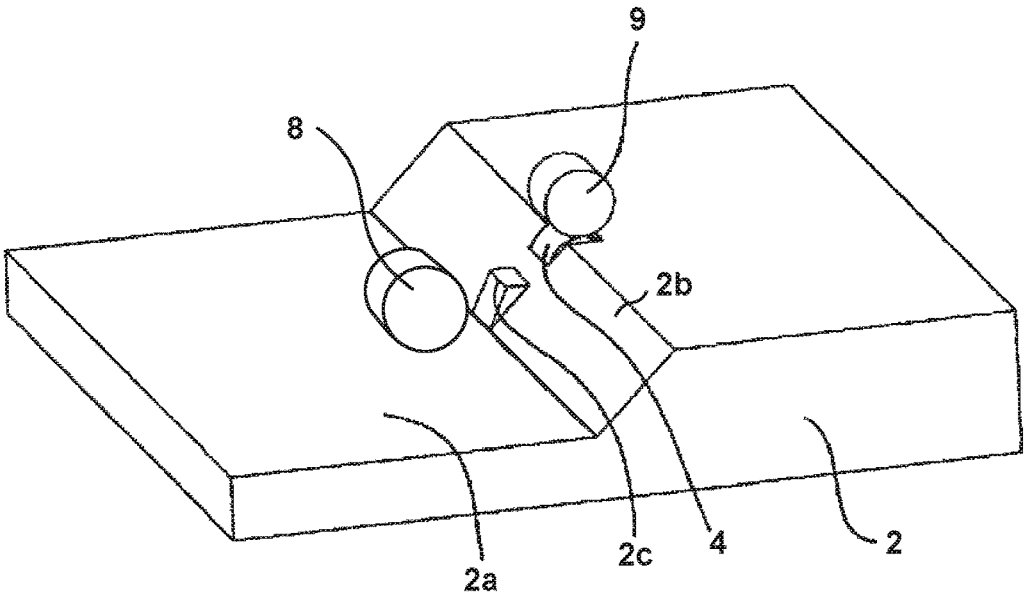
FIG. 11B is a schematic perspective view of the sheet feeder of the fourth embodiment.

As shown in FIGS. 11A and 11B, in an image reading apparatus 100 of this embodiment, a projection 2*c* is formed in a central portion of an inclined surface 2*b* of a lower unit 2 in the widthwise direction of a document sheet stacking surface 2*a*. The rest of the configuration is the same as that shown in FIG. 1.

The apex of the projection 2*c* is positioned near a straight line connecting a point P1 and a point P2. Since the projection 2*c* pushes up a document sheet from below when feeding the document sheet, therefore, a slack of the document sheet on the inclined surface 2*b* is suppressed, and jam (paper jam) during document sheet feed can be suppressed. When feeding a hardly bendable document sheet such as a plastic card, however, feed becomes difficult because the leading edge of the card cannot climb over the projection 2*c*. Note that the projection 2*c* may also be formed by an elastically deformable material such as a rubber material or sponge. This makes it possible to feed a firm document sheet.

Figure 12:
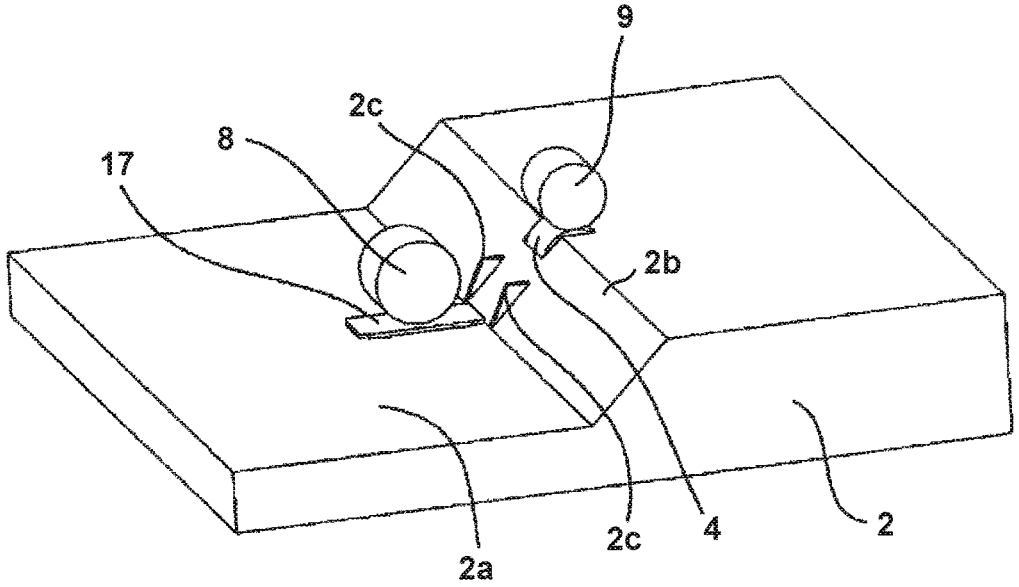
FIG. 12 is a schematic perspective view of a sheet feeder of a modification of the fourth embodiment.
Figure 13:
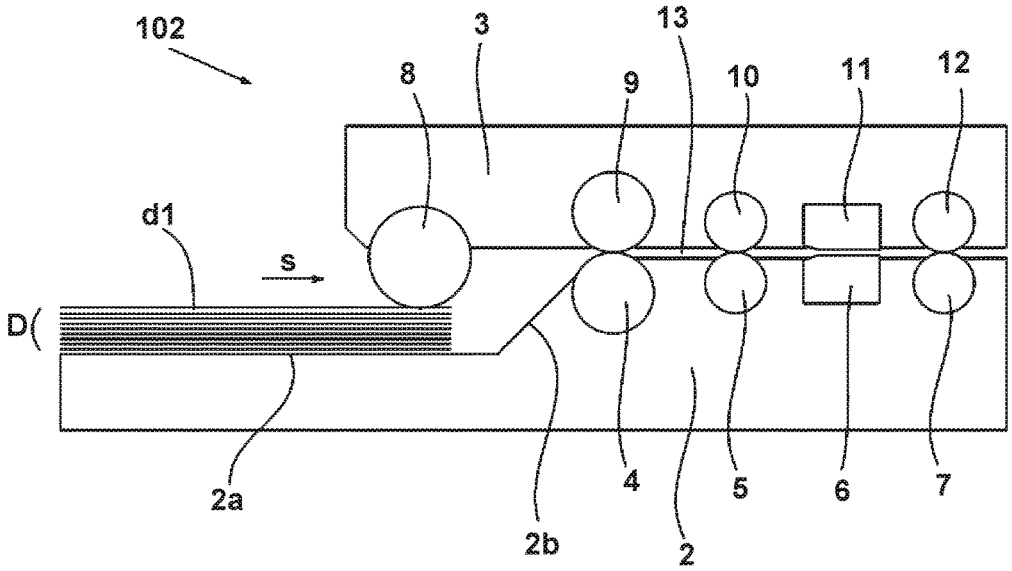
FIG. 13 is a schematic side view of a conventional sheet feeder.
Figure 14:
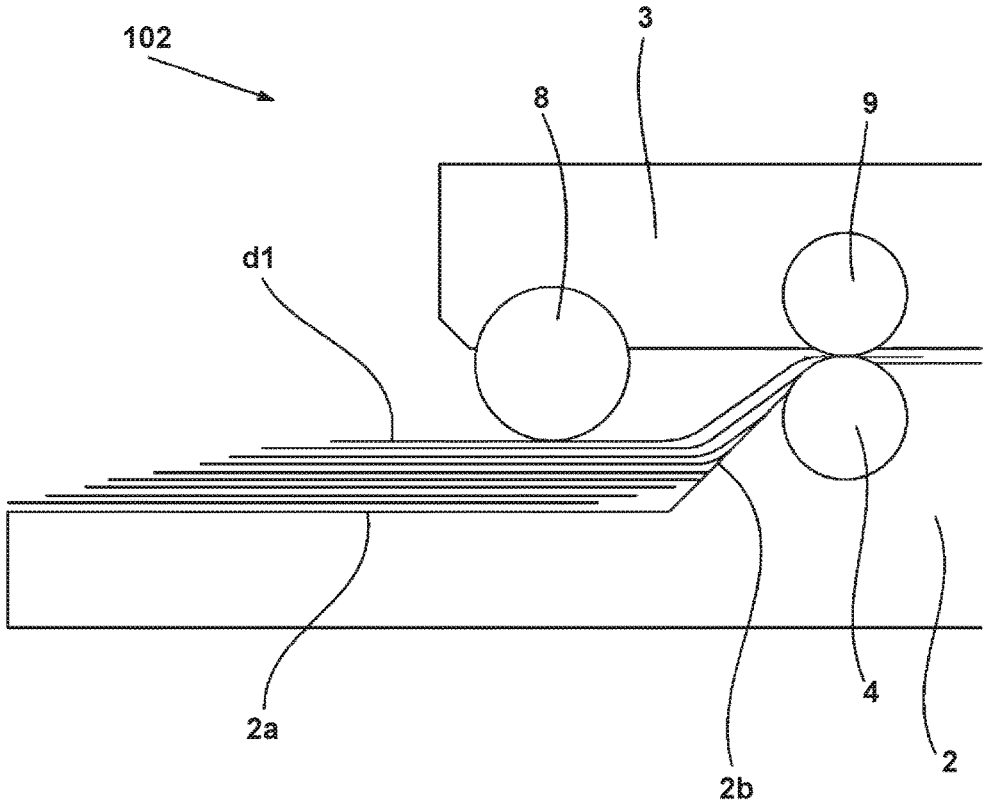
FIG. 14 is a schematic side view of the conventional sheet feeder.
Figure 15:
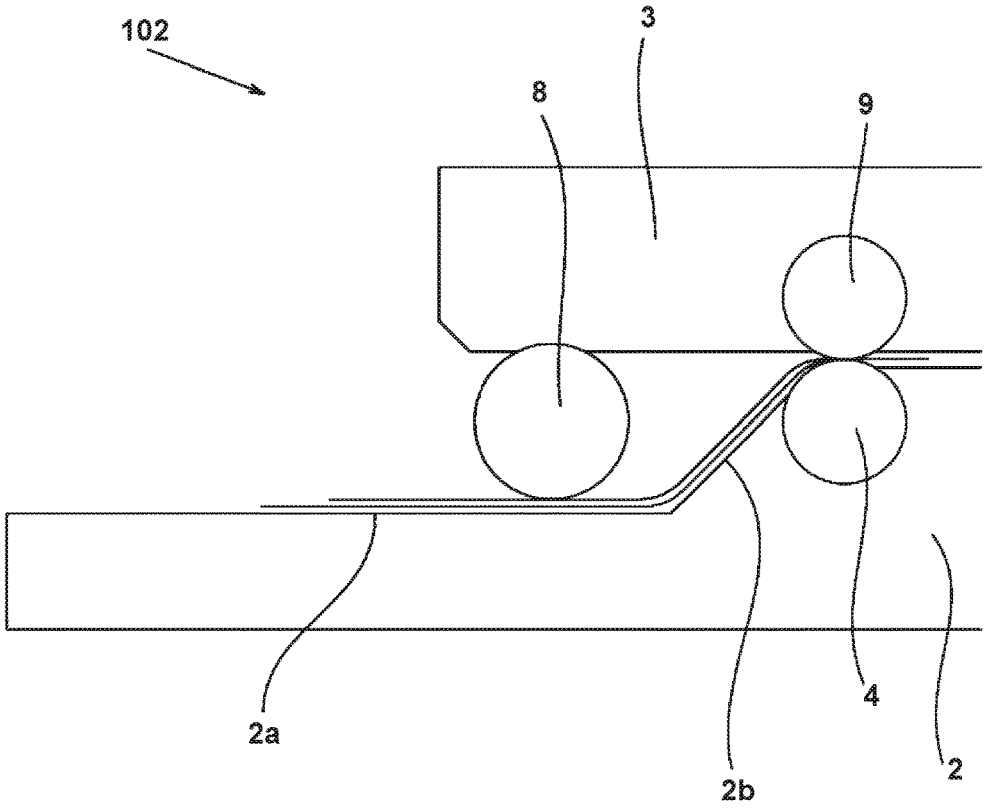
FIG. 15 is a schematic side view of the conventional sheet feeder.

Also, to implement feed of a plastic card, as shown in FIG. 12, a plurality of projections 2*c* can be formed apart from each other in the axial direction of a pickup roller 8 so as to avoid a card feeding region. A plastic card 17 can be fed by passing it between the plurality of projections 2*c*.

The present invention is not limited to above-described embodiments according to the above-described horizontal document sheet stacking type feeding configuration, and is also applicable to other forms of sheet stacking, for example, a so-called vertical stacking type in which sheets are stacked in the horizontal direction, and a so-called inclined stacking type in which a stack of sheets is inclined in a so-called horizontal stacking type in which the sheet surfaces are the horizontal direction. In either case, the present invention can implement stable separate feed by holding the sheet feed orientation so as to suppress a slack of a sheet before being separately fed with respect to a sheet currently being separately fed.

Also, the sheet feeder of the present invention is applicable not only to the image reading apparatuses of the above-described embodiments, but also to image forming apparatuses (for example, a printer, copying machine, multifunctional peripheral, and facsimile apparatus) for performing printing on a sheet. In addition, the sheet feeder of the present invention is applicable to a sheet processing apparatus for feeding a sheet and performing predetermined processing on it.

The present invention is not limited to the above-described embodiments, and various changes and modifications can be made within the spirit and scope of the present invention. Therefore, to apprise the public of the scope of the present invention, the following claims are made.

REFERENCE SIGNS LIST

100, 101 . . . image reading apparatus, 2 . . . lower guide unit, 3 . . . upper guide unit, 4 . . . separation roller, 8 . . . pickup roller, 9 . . . feed roller, 140 . . . guide member

What is claimed is:

1. A sheet feeder comprising:

a sheet stacking unit configured to stack sheets;

a sheet pickup unit configured to pick up a sheet from one side of the stacked sheets on the sheet stacking unit and to move up and down in accordance with a stacked sheet amount;

a sheet separating and feeding unit, arranged downstream of the sheet pickup unit in a sheet feeding direction and at a position adjoining an inclined surface which inclines in the sheet feeding direction for separating the stacked sheets, and configured to separately feed sheets one by one to a conveyance path, wherein a sheet picked up from the sheet stacking unit by the sheet pickup unit is separately fed from the sheet stacking unit to the conveyance path on the downstream side in the sheet feeding direction via the inclined surface;

an orientation holding unit configured to hold a feed orientation of a sheet currently being separately fed by acting on the sheet, the orientation holding unit being formed between the sheet pickup unit and the sheet separating and feeding unit; and a biasing unit configured to contact the orientation holding unit and bias the orientation holding unit from a retracted position where the orientation holding unit is retracted relative to the inclined surface to a projecting position where the orientation holding unit is projected from the inclined surface, wherein the orientation holding unit has an upper end on the downstream side in the sheet feeding direction and a lower end on the upstream side in the sheet feeding direction, the orientation holding unit is axially supported at the lower end in the vicinity of the intersection of the sheet stacking unit and the inclined surface so as to make the orientation holding unit swingable, the orientation holding unit is displaceable between the projecting position where the upper end of the orientation holding unit projects from the inclined surface and the retracted position where the upper end of the orientation holding unit is retracted, in the vicinity of the intersection, and a projection amount of the orientation holding unit from the inclined surface increases as the number of stacked sheets decreases, and the projection amount from the inclined surface decreases against a biasing force of the biasing unit as the number of stacked sheets increases, and the orientation holding unit has a function of holding the feed orientation of a sheet picked up from the sheet stacking unit by the sheet pickup unit by pushing up the sheet in the projecting position.

2. The sheet feeder according to claim 1, wherein the orientation holding unit is accommodated in a recess formed in the inclined surface at the retracted position.

3. The sheet feeder according to claim 1, further comprising a pickup roller formed as the sheet pickup unit configured to rotate in tight contact with an uppermost sheet of the stacked sheets, and a feed roller and a separation roller formed as the sheet separating and a feeding unit configured to separately feed sheets picked up by the pickup roller to the conveyance path one after another, wherein letting p1 be a contact point between the uppermost sheet of the sheet stacking unit and the pickup roller, and p2 be a contact point between the feed roller and the separation roller, the projecting position of the orientation holding unit exists on a straight line connecting the contact point p1 and the contact point p2.

4. A sheet feeder comprising:

a sheet stacking unit configured to stack sheets;

a sheet pickup unit configured to pick up a sheet from one side of the stacked sheets on the sheet stacking unit;

a sheet separating and feeding unit, arranged downstream of the sheet pickup unit in a sheet feeding direction, and configured to separately feed sheets one by one to a conveyance path, wherein a sheet picked up from the sheet stacking unit by the sheet pickup unit is separately fed from the sheet stacking unit to the conveyance path on the downstream side in the sheet feeding direction via an inclined surface which inclines in the sheet feeding direction for separating the stacked sheets;

an orientation holding unit configured to hold a feed orientation of a sheet currently being separately fed by acting on the sheet, the orientation holding unit being formed between the sheet pickup unit and the sheet separating and feeding unit;

a biasing unit configured to bias the orientation holding unit from a retracted position to a projecting position, wherein the orientation holding unit is displaceable between the projecting position where the orientation holding unit projects from the inclined surface and the retracted position where the orientation holding unit is retracted in the vicinity of an intersection between the sheet stacking unit and the inclined surface, a projection amount of the orientation holding unit from the inclined surface increases as the number of stacked sheets decreases, and the projection amount from the inclined surface decreases against a biasing force of the biasing unit as the number of stacked sheets increases, and the orientation holding unit has a function of holding the feed orientation of a sheet picked up from the sheet stacking unit by the sheet pickup unit by pushing up the sheet in the projecting position; and a driving unit configured to displace the orientation holding unit, wherein the orientation holding unit is displaced by the driving unit between the projecting position and a position where the orientation holding unit stands upright and is perpendicular to the surface of the sheet stacking unit, the orientation holding unit has a function of regulating the stacked sheets on the sheet stacking unit by causing the sheets to abut the orientation holding unit in the upright position in order to align leading edges of the sheets, and the orientation holding unit is axially supported in the vicinity of the intersection of the sheet stacking unit and the inclined surface so as to make the orientation holding unit swingable.

5. The sheet feeder according to claim 4, wherein the driving unit includes a cam member which is rotated in a state in which the cam member is engaged with the orientation holding unit.

6. An image reading apparatus having a sheet feeder which feeds sheets to an image reading unit, the sheet feeder comprising:

a sheet stacking unit configured to stack sheets;

a sheet pickup unit configured to pick up a sheet from one side of the stacked sheets on the sheet stacking unit and to move up and down in accordance with a stacked sheet amount;

a sheet separating and feeding unit, arranged downstream of the sheet pickup unit in a sheet feeding direction and at a position adjoining an inclined surface which inclines in the sheet feeding direction for separating the stacked sheets, and configured to separately feed sheets one by one to a conveyance path, wherein a sheet picked up from the sheet stacking unit by the sheet pickup unit is separately fed from the sheet stacking unit to the conveyance path on the downstream side in the sheet feeding direction via the inclined surface;

an orientation holding unit configured to hold a feed orientation of a sheet currently being separately fed by acting on the sheet, the orientation holding unit being formed between the sheet pickup unit and the sheet separating and feeding unit; and a biasing unit configured to contact the orientation holding unit and bias the orientation holding unit from a retracted position where the orientation holding unit is retracted relative to the inclined surface to a projecting position where the orientation holding unit is projected from the inclined surface, wherein the orientation holding unit has an upper end on the downstream side in the sheet feeding direction and a lower end on the upstream side in the sheet feeding direction, the orientation holding unit is axially supported at the lower end in the vicinity of the intersection of the sheet stacking unit and the inclined surface so as to make the orientation holding unit swingable, the orientation holding unit is displaceable between the projecting position where the upper end of the orientation holding unit projects from the inclined surface and the retracted position where the upper end of the orientation holding unit is retracted, in the vicinity of the intersection, and a projection amount of the orientation holding unit from the inclined surface increases as the number of stacked sheets decreases, and the projection amount from the inclined surface decreases against a biasing force of the biasing unit as the number of stacked sheets increases, and the orientation holding unit has a function of holding the feed orientation of a sheet picked up from the sheet stacking unit by the sheet pickup unit by pushing up the sheet in the projecting position.

7. An image forming apparatus having a sheet feeder which feeds sheets to an image forming unit, the sheet feeder comprising:

a sheet stacking unit configured to stack sheets;

a sheet pickup unit configured to pick up a sheet from one side of the stacked sheets on the sheet stacking unit and to move up and down in accordance with a stacked sheet amount;

a sheet separating and feeding unit, arranged downstream of the sheet pickup unit in a sheet feeding direction and at a position adjoining an inclined surface which inclines in the sheet feeding direction for separating the stacked sheets, and configured to separately feed sheets one by one to a conveyance path, wherein a sheet picked up from the sheet stacking unit by the sheet pickup unit is separately fed from the sheet stacking unit to the conveyance path on the downstream side in the sheet feeding direction via the inclined surface;

an orientation holding unit configured to hold a feed orientation of a sheet currently being separately fed by acting on the sheet, the orientation holding unit being formed between the sheet pickup unit and the sheet separating and feeding unit; and a biasing unit configured to contact the orientation holding unit and bias the orientation holding unit from a retracted position where the orientation holding unit is retracted relative to the inclined surface to a projecting position where the orientation holding unit is projected from the inclined surface, wherein the orientation holding unit has an upper end on the downstream side in the sheet feeding direction and a lower end on the upstream side in the sheet feeding direction, the orientation holding unit is axially supported at the lower end in the vicinity of the intersection of the sheet stacking unit and the inclined surface so as to make the orientation holding unit swingable, the orientation holding unit is displaceable between the projecting position where the upper end of the orientation holding unit projects from the inclined surface and the retracted position where the upper end of the orientation holding unit is retracted, in the vicinity of the intersection, and a projection amount of the orientation holding unit from the inclined surface increases as the number of stacked sheets decreases, and the projection amount from the inclined surface decreases against a biasing force of the biasing unit as the number of stacked sheets increases, and the orientation holding unit has a function of holding the feed orientation of a sheet picked up from the sheet stacking unit by the sheet pickup unit by pushing up the sheet in the projecting position.

* * * * *